US010064494B2

(12) United States Patent
Mackert

(10) Patent No.: US 10,064,494 B2
(45) Date of Patent: Sep. 4, 2018

(54) RETRACTION AND EXTENSION DEVICE FOR A FOOT AND/OR LEG SUPPORT OF AN ITEM OF SEATING AND/OR LOUNGING FURNITURE

(71) Applicant: Innotec Motion GmbH, Lippstadt (DE)

(72) Inventor: Michael Mackert, Ruethen (DE)

(73) Assignee: INNOTEC MOTION GMBH, Lippstadt (DE)

( * ) Notice: Subject to any disclaimer, the term of this patent is extended or adjusted under 35 U.S.C. 154(b) by 0 days.

(21) Appl. No.: 14/889,415

(22) PCT Filed: Apr. 15, 2014

(86) PCT No.: PCT/EP2014/057640
§ 371 (c)(1),
(2) Date: Nov. 5, 2015

(87) PCT Pub. No.: WO2014/183950
PCT Pub. Date: Nov. 20, 2014

(65) Prior Publication Data

US 2016/0073785 A1 Mar. 17, 2016

(30) Foreign Application Priority Data

May 13, 2013 (DE) ..... 20 2013 102 073 U

(51) Int. Cl.
*A47C 7/50* (2006.01)
*A47C 1/034* (2006.01)
*A47C 1/022* (2006.01)

(52) U.S. Cl.
CPC ..... *A47C 7/506* (2013.01); *A47C 1/022* (2013.01); *A47C 1/0345* (2013.01); *A47C 7/503* (2013.01)

(58) Field of Classification Search
CPC ..... A47C 7/503; A47C 7/506; A47C 1/0345
See application file for complete search history.

(56) References Cited

U.S. PATENT DOCUMENTS 3,767,257 A * 10/1973 Rogers, Jr. ..... A47C 3/027 297/259.2
3,790,211 A * 2/1974 Caldwell ..... A47C 7/506 297/423.18

(Continued)

FOREIGN PATENT DOCUMENTS

CN 1183255 A 6/1998
CN 201175153 Y 1/2009

(Continued)

OTHER PUBLICATIONS

International Search Report of PCT/EP2014/051640, dated Jul. 28, 2014.

*Primary Examiner* — Timothy J Brindley
(74) *Attorney, Agent, or Firm* — Cohen & Hilderbrand, PLLC

(57) ABSTRACT

A retraction and extension device (100) for a foot and/or leg support of an item of seating and/or lounging furniture, with two substantially parallel arms (102), each arm (102) includes a first fastener (106) for rotatable fastening to a chassis (108) of the item of seating and/or lounging furniture, second fastener (110) for fastening the foot and/or leg support to the respective arm (102), and a plurality of struts arranged in two rows (104), in each of the rows (104) the struts of the respective row (104) are connected in a rotatable manner to each other. Some of the struts in each of the rows (104) are connected in a rotatable manner to at least one strut of the respective other row (104), wherein the first and the second fastener are spaced apart from each other by a distance of less than 50 cm.

10 Claims, 5 Drawing Sheets

(56) References Cited

Figure 1:
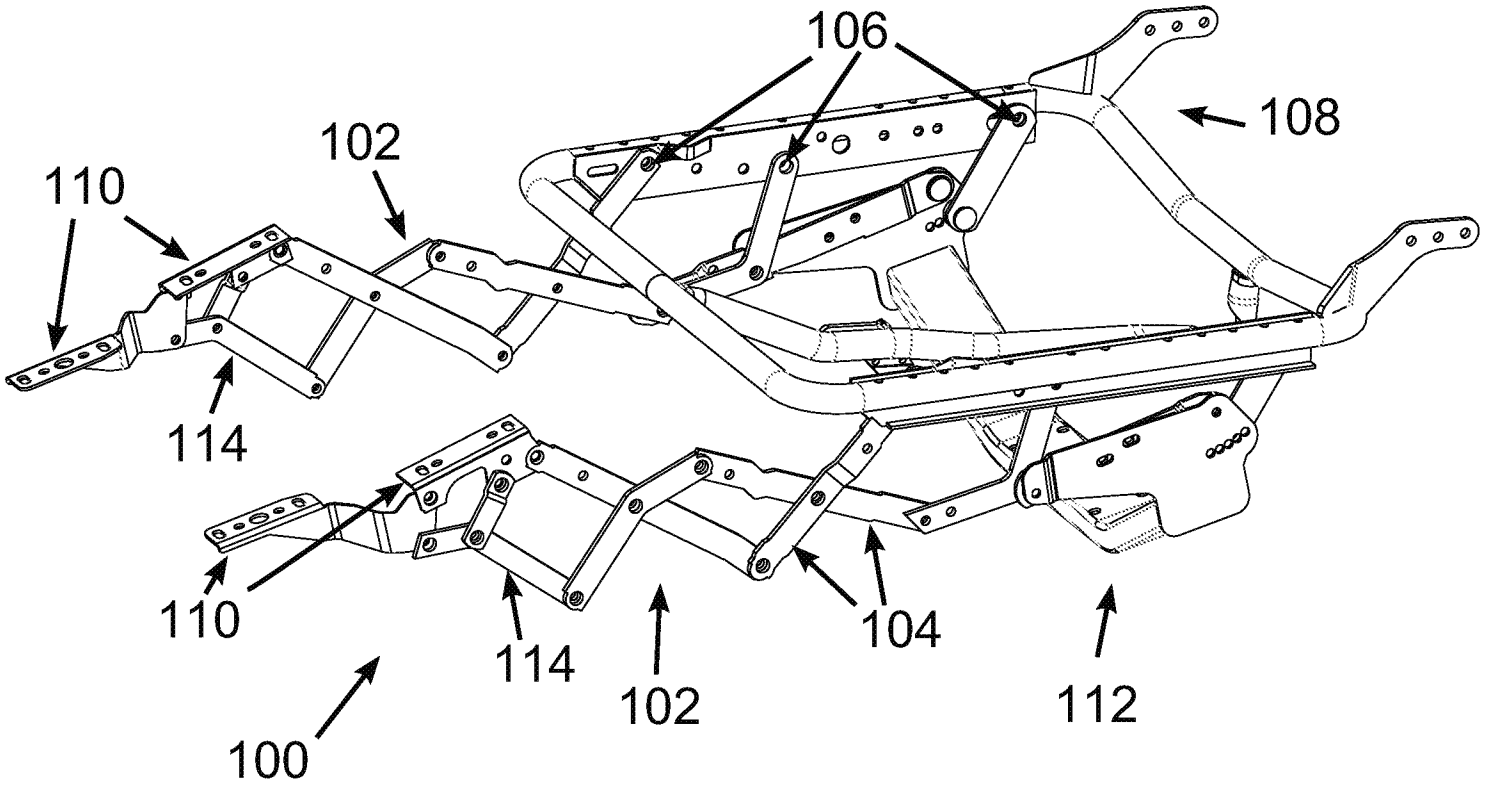

U.S. PATENT DOCUMENTS 3,926,472 A * 12/1975 Evans ..... A47C 1/0345 297/259.2
4,423,903 A * 1/1984 Gerth ..... A47C 1/0345 297/68
4,570,996 A * 2/1986 Rogers, Jr. ..... A47C 7/506 297/68
4,669,778 A * 6/1987 Rogers, Jr. ..... A47C 7/506 297/68
4,740,031 A * 4/1988 Rogers, Jr. ..... A47C 1/0345 297/232
5,076,644 A 12/1991 Northcutt
5,090,768 A * 2/1992 Re ..... A47C 7/506 297/68
5,312,153 A * 5/1994 Lin ..... A47C 1/0345 297/68
5,503,453 A * 4/1996 Saul ..... A47C 1/0345 297/89
9,326,615 B1 * 5/2016 LaPointe ..... A47C 7/506
2005/0146166 A1 7/2005 Tai
2008/0290710 A1 * 11/2008 Lawson ..... A47C 1/0345 297/337
2010/0283297 A1 11/2010 Crum
2011/0193373 A1 8/2011 Lawson et al.
2012/0248831 A1 * 10/2012 Garland ..... A47C 7/506 297/84
2013/0169018 A1 * 7/2013 Fischer ..... A47C 7/506 297/423.19
2013/0341989 A1 * 12/2013 Lin ..... A47C 7/506 297/423.28
2014/0070588 A1 * 3/2014 Wittenberg, Jr. .. A47C 1/03211 297/362.11
2014/0091606 A1 * 4/2014 Waltz ..... A47C 1/0242 297/354.1
2015/0320215 A1 * 11/2015 Flamme ..... A47C 1/0242 297/463.1
2015/0366355 A1 * 12/2015 Carrera ..... A47C 7/506 297/423.19
2016/0058195 A1 * 3/2016 Huang ..... A47C 1/031 248/398
2016/0066692 A1 * 3/2016 Lin ..... A47C 1/0355 297/354.1

FOREIGN PATENT DOCUMENTS

CN 101484045 A1 7/2009
CN 102133006 A 7/2011
CN 202146108 U 2/2012
CN 102871397 A 1/2013
DE 202005000546 U1 3/2005
DE 202009013014 A1 2/2010
DE 202009013014 U1 3/2010
EP 0133022 A1 2/1985
EP 0468686 A1 1/1992

* cited by examiner

RETRACTION AND EXTENSION DEVICE FOR A FOOT AND/OR LEG SUPPORT OF AN ITEM OF SEATING AND/OR LOUNGING FURNITURE

This is an application filed under 35 USC § 371 of PCT/EP2014/057640 filed on Apr. 15, 2014 claiming priority to DE 20 2013 102 073.7 filed on May 13, 2013.

BACKGROUND OF THE INVENTION

The present invention relates to a retraction and extension device for foot and/or leg support of an item of seating and/or lounging furniture according to the preamble of claim 1 and an item of seating and/or lounging furniture with such retraction and extension device.

A foot and/or leg support of an item of seating and/or lounging furniture can be retracted and extended, so that the item of seating and/or reclining furniture takes up little space when retracted. In the extended state, a user can put his feet and/or legs on the foot and/or leg support.

In conventional extension mechanisms, the foot and/or leg support is attached to two legs that have a plurality of struts. The struts are rotatably connected to each other and arranged in two rows, with the struts of one of the rows each being rotatably connected to the struts of the other row.

When retracted, two interconnected struts of each of the rows enclose a relatively small angle, so that the entire retraction and extension device has a relatively small length. During the extension operation, the angles between the struts increase, causing the length of retraction and extension device to increase. In addition, the second fastening means are pivoted upwardly from below the chassis of the item of seating and/or lounging furniture, so that a foot and/or leg rest attached to the second fastening means is likewise pivoted upwardly.

The movement of the struts can also be referred to as an accordion-type fashion. The retraction operation is mechanically reversed compared to the extension operation.

It is an object of the invention to provide a retraction and extension device of the aforementioned type which is suitable for seating and/or reclining furniture with a relatively small chassis.

BRIEF SUMMARY OF THE INVENTION

This object is attained by the first and the second fastener being spaced apart, when the foot and/or leg support is extended, by a distance of less than 50 cm.

Embodiments of the invention are recited in the dependent claims.

Due to the fact that the first and the second fastening means are spaced apart from each other by a distance of less than 50 cm, preferably 35 to 45 cm, when the foot and/or leg support is extended, the entire retraction and extension device becomes more compact and can be readily used for seating and/or lounging furniture with a narrow and/or short chassis. The increased compactness is advantageous especially in the retracted state since the most installation space is here required below the chassis.

Chassis refers in particular to the part of the item of seating and/or reclining furniture that guarantees as a basic framework the mechanical stability of the item of seating and/or reclining furniture. For example, arm and back rests and padding of various types can be attached on the chassis. The chassis is visible only partially or not at all during the intended use of the item of seating and/or reclining furniture.

Retracted state refers to the state where the foot and/or leg rest is arranged beneath the chassis The extended state is just the opposite of the retracted state, where the foot and/or leg rest is disposed substantially in alignment with a seating area of the seating and/or reclining furniture.

The rotatable interconnection between the struts of each of the rows can be achieved, for example, in that each strut has one or several recesses. Two struts can then be pivotally connected together by using screws or rivets, so that the rotation axis extends through the respective recesses.

All statements regarding the legs of the retraction and extension device are to be understood as to apply to each of the two legs. Preferably, the two legs have identical features.

According to one embodiment of the invention, the first fastening means may include recesses at several of the struts of the two rows. For example, these struts may be rotatably mounted on the chassis by way of screw and/or rivet connections.

According to one embodiment of the invention, the second fastening means may include recesses at several of the struts of the two rows. The foot and/or leg support can then be rotatably attached to the struts with screw and/or rivet connections.

According to one embodiment of the invention, the second fastening means may be at least partially disposed on one of the struts that has an angled section. This strut may also be described as a strut having two sections, wherein the two sections enclose with each other an angle less than 180°. Several of the struts may be constructed in this manner. This angled strut enables, inter alia, pivoting of the second fastening means during the retraction and/or extension operation. Thus, the second fastening means are substantially arranged below the seating area of the item of seating and/or reclining furniture in the retracted state. During the extension operation, the second fastening means are pivoted so that an attached foot and/or leg support is in alignment with the seating area, thus enabling a user to place his feet and/or legs comfortably thereon.

According to one embodiment of the invention, each of the legs may have at least one release strut, The release strut may include at least a portion of the first fastening means and extend in the retracted state of the retraction and extension device, starting at the first attachment means, away from the second fastening means. This may mean that the release strut extends, for example, rearward with a downward slope, whereas the second fastening means are, for example, arranged obliquely in front of the first fastening means. In other words, the release strut may extend in the retracted state in the direction of a backside of the item of seating and/or reclining furniture. Backside refers herein in particular to the side where a backrest of the seating and/or reclining furniture is arranged.

It is also possible to provide several release struts of the aforedescribed type. The at least one release strut has the advantage that the extension operation cannot be triggered by only the body weight of a user. The force from the body weight operates rearwards due to the release struts. The extension operation is only triggered when the user applies with his body a forward force on the release struts. As soon as the at least one release strut has been moved across a dead center, the extension operation is driven by the weight of the user. The dead center is hereby the position of the at least one release strut at which it extends vertically downwards.

According to one embodiment of the invention, the extension mechanism may include connecting means that interconnects the two legs. These connecting means increase the stability of the retraction and extension device.

According to one embodiment of the invention, the at least one release strut may include fastening means for attachment to the connecting means. In this case, the at least one release strut may be only indirectly with other struts of the legs. It is also possible that the release strut is connected to the respective leg only via the connecting means. The connecting means hence connect, on the one hand, the legs with one another and, on the other hand, the at least one release strut with the respective leg.

According to one embodiment of the invention, the retraction and extension device may be configured such that the struts of each of the rows rotate with respect to the struts of the corresponding other row during a retraction and extension operation. In this way, the retraction and extension device takes up significantly less space when retracted than when extended and can therefore be arranged in a space-saving manner underneath the seating area of the item of seating and/or reclining furniture, so as not to disturb a user.

According to one embodiment of the invention, the retraction and extension device may be configured such that during retraction and extension operation at least some of the struts of both rows rotate relative to the chassis of the item of seating and/or reclining furniture and relative to the second fastening means.

In another aspect, the invention relates to a system composed of a retraction and extension device according to an embodiment of the invention and an item of seating and/or reclining furniture with a foot and/or leg support.

BRIEF DESCRIPTION OF THE DRAWNGS

Figure 2:
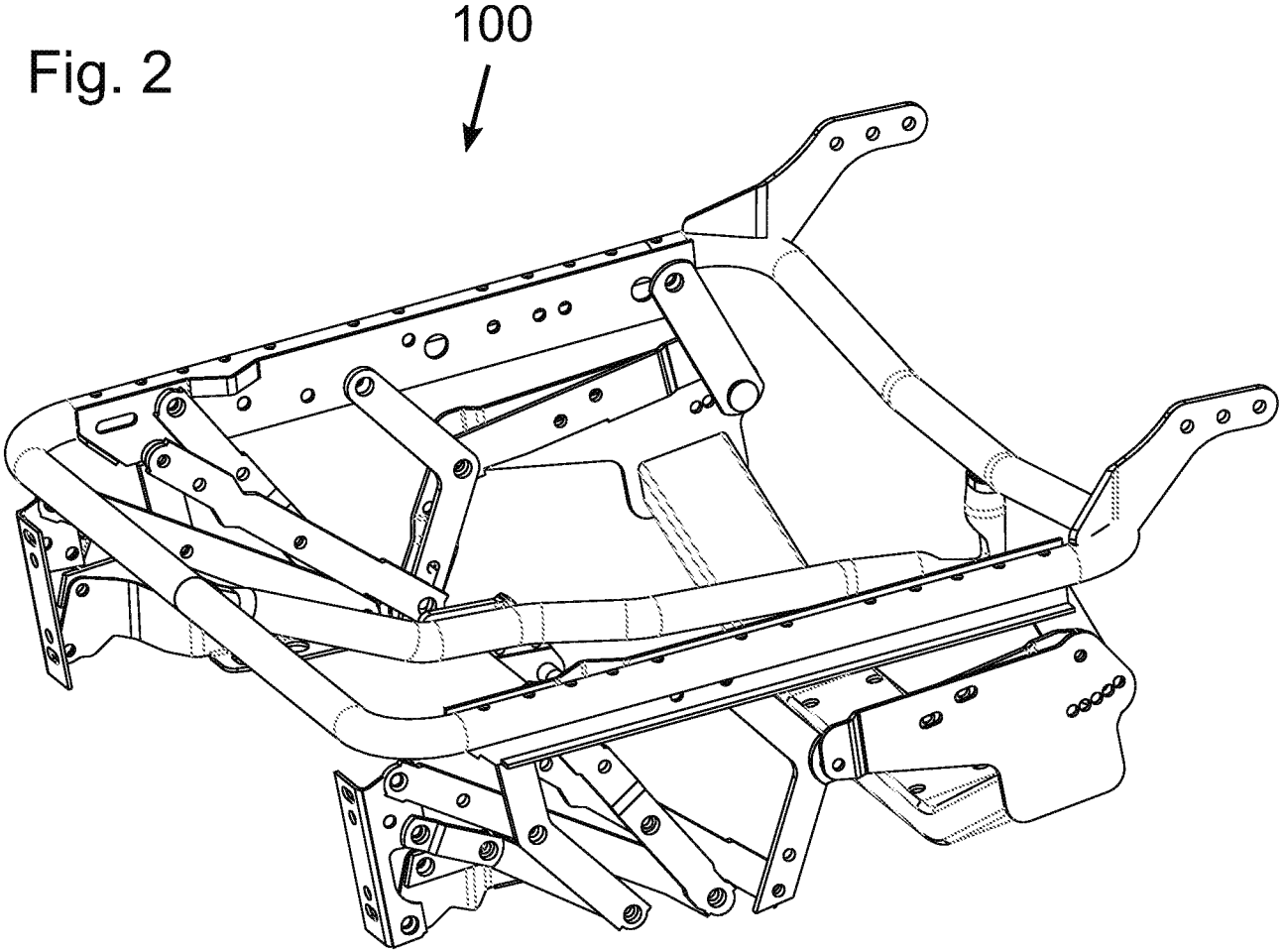
Figure 3B:
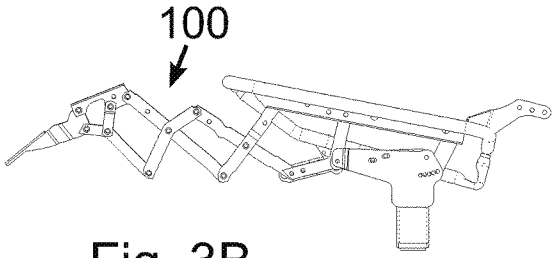
Figure 3D:
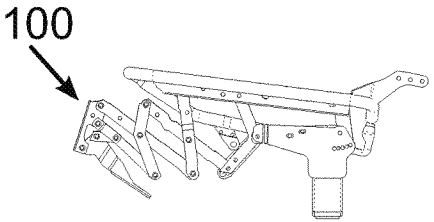
Figure 3A:
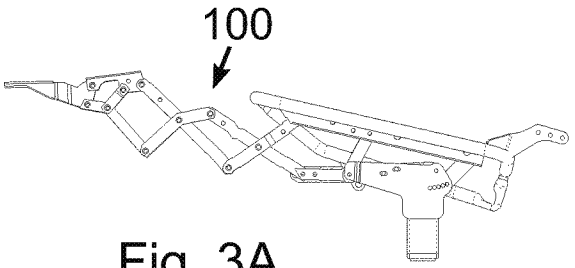
Figure 3C:
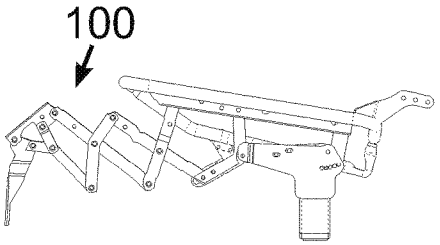
Figure 3E:
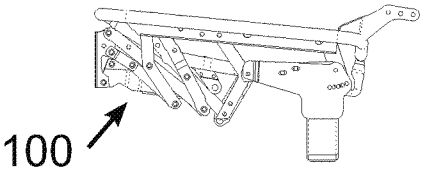

Additional features and advantages of the present invention will become apparent from the following description of preferred exemplary embodiments with reference to the accompanying drawings. Identical or similar components and components performing identical or similar functions are provided with identical reference symbols. The drawings show in:

FIG. 1 a schematic perspective view of a retraction and extension device according to an embodiment of the invention in the extended state;

FIG. 2 the retraction and extension device of FIG. 1 in the retracted state;

FIG. 3 schematic side views of a retraction operation of the retraction and extension device;

FIG. 4 schematic plan views of a retraction operation the retraction and extension device; and FIG. 5 sectional views according to the section lines of FIG. 4.

DETAILED DESCRIPTION OF THE INVENTION

The figures show a retraction and extension device 100 attached to a chassis 108. The retraction and extension device 100 includes two legs 102 which each include a plurality of struts. The struts are arranged in two intersecting rows 104. The struts of both rows 104 of a leg 102 extend partially inside and partially outside. This approach ensures a particularly high stability of the legs 102.

Each of the legs 102 has first fastening means 106 for attachment to the chassis 108. In addition, each of the legs 102 includes second fastening means 110 for attaching to the legs 102 a foot and/or leg support (not shown in the figures). The two legs are interconnected with connecting means 112. The connecting means 112 further increase the stability of the retraction and extension device 100.

In addition, each of the legs 102 has an angled strut 114. This angled strut 114 is connected to the second fastening means 110 and ensures that the second fastening means 110 are pivoted upward in an extension operation. The angle between the second fastening means 110 and the legs 102 therefore changes during the extension operation.

A comparison between the FIGS. 1 and 2 clearly shows that the retraction and extension device 100 requires very little space in the retracted state (FIG. 2) and is positioned completely under the chassis 108, thus preventing a user from being disturbed. This is possible, due to the compact form, also with a relatively small chassis 108. Conversely, in the extended state (FIG. 1), the retraction and extension device 100 attains due to the accordion-like deformation a length of less than 50 cm, for example, about 35 to 45 cm, so an unillustrated foot and/or leg support attached on the second fastening means 110 can be used to rest the feet and/or legs of a user.

FIGS. 3 to 5 illustrate different stages of a retraction operation. The state of the retraction and extension device 100 in FIG. 3A corresponds hereby to that in FIGS. 4A and 5A. The same applies to the other FIGS. 3C to 3E, 4C to 4E and 5C to 5E.

Figure 4A:
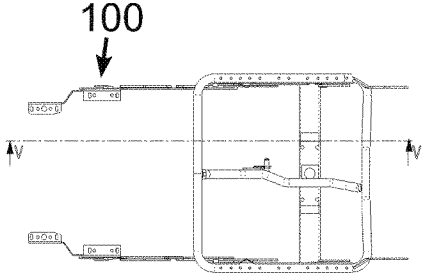
Figure 4B:
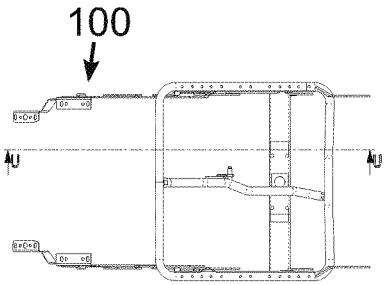
Figure 4C:
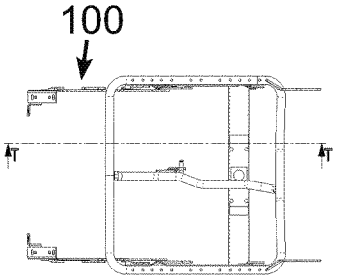
Figure 4D:
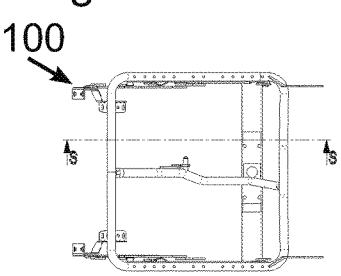
Figure 4E:
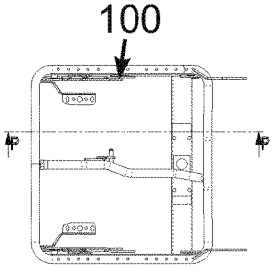
Figure 5B:
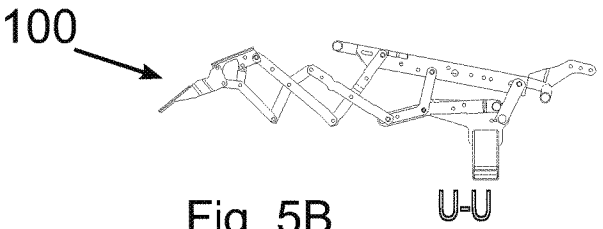
Figure 5D:
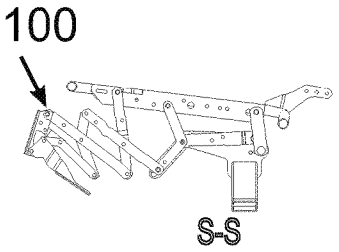
Figure 5A:
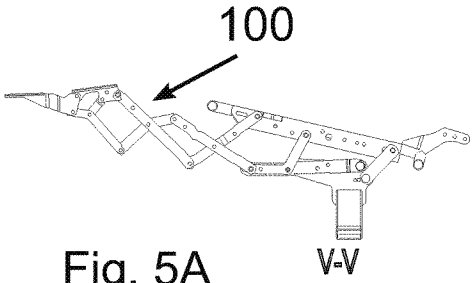
Figure 5C:
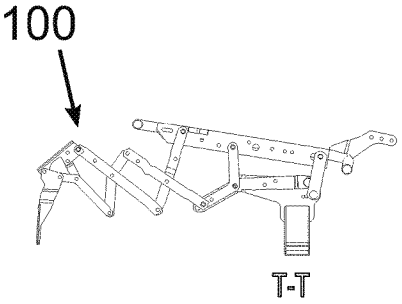
Figure 5E:
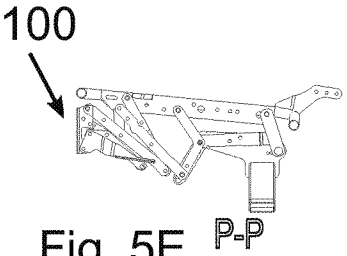

FIGS. 4A to 4E—show section lines V-V (FIG. 4A) to P-P (FIG. 4E). The corresponding cross-sectional views are reproduced as FIGS. 5A to 5E.

The extension operation of retraction and extension device 100 takes place in principle by a mechanical reversal of retraction operation. The extension operation can thus be understood by the viewing the FIGS. 3 to 5 in the reverse order, i.e. for example from FIG. 3E to FIG. 3A.

The invention claimed is:

1. A retraction and extension device (100) for a foot and/or leg support of an item of seating and/or lounging furniture, comprising:

two substantially parallel legs (102), each leg (102) comprising first fastener (106) for rotatably attaching to a chassis (108) of the item of the seating and/or lounging furniture, second fastener (110) for attaching the foot and/or leg support to the respective leg (102), and each leg (102) further comprising a plurality of struts disposed in two rows (104) including a first row and a second row, wherein in each of the rows (104), the struts of a respective row (104) are rotatably interconnected end to end from the first fastener to the second fastener, and wherein for each leg (102) more than one of the struts in the first row (104) is rotatably connected to a respective strut of the second row (104), wherein the first and the second fastener are spaced apart, when the foot and/or leg support is extended, by a distance of less than 50 cm, wherein for each leg (102), extending from the first fastener to the second fastener, each of the plurality of struts in a respective row are arranged one following another in an alternating manner inward towards the opposing leg (102) and outwards away from the opposing leg (102), wherein the second fastener (110) is at least partially arranged on an angled strut (114), wherein the angled strut (114) is one of the plurality of struts of the leg (102).

2. The retraction and extension device (100) according to claim 1, wherein the first fastener (106) comprise recesses disposed on several struts of the two rows (104).

3. The retraction and extension device (100) according to claim 1, wherein the second fastener (110) comprise recesses on several struts of the two rows (104).

4. The retraction and extension device (100) according to claim 1, wherein each of the legs (102) comprises at least one release strut, wherein the at least one release strut includes at least a portion of the first fastener (106); while the retraction and extension device (100) is in the retracted state, the at least one release strut extends, starting from the first fastener (106), away from the second fastener (110).

5. The retraction and extension device (100) according to claim 1, wherein the retraction and extension device (100) comprises connecter (112) that interconnect the two legs (102) with each other.

6. The retraction and extension device (100) according to claim 4, wherein the at least one release strut comprises fastener for attachment to the connecter (112).

7. The retraction and extension device (100) according to claim 1, wherein the retraction and extension device (100) is configured such that the struts of each of the rows (104) rotate in relation to the struts of the respective other row (104) during an extension and retraction operation.

8. The retraction and extension device (100) according to claim 1, wherein the retraction and extension device (100) is configured such that at least one of the struts of both rows (104) rotate during an extension and retraction operation in relation to the chassis (108) of the seating and/or reclining furniture and in relation to the second fastener (110).

9. The retraction and extension device (100) according to claim 1, wherein the first and the second fastener (110) are spaced apart, when the foot and/or leg support is extended, by a distance of 35 to 45 cm.

10. A system comprising an item of seating and/or lounging furniture with a foot and/or leg support; and a retraction and extension device (100) for the foot and/or leg support according to claim 1.

* * * * *